US007284678B2

(12) United States Patent
Bloom et al.

(10) Patent No.: US 7,284,678 B2
(45) Date of Patent: Oct. 23, 2007

(54) CAPSULE DISPENSING APPARATUS WITH REFRIGERATION

(76) Inventors: Barry L. Bloom, 6834 SE. 83rd, Portland, OR (US) 97266; Pearl M. Mead, 6834 SE. 83rd, Portland, OR (US) 97266

( * ) Notice: Subject to any disclaimer, the term of this patent is extended or adjusted under 35 U.S.C. 154(b) by 257 days.

(21) Appl. No.: 11/092,381

(22) Filed: Mar. 29, 2005

(65) Prior Publication Data

US 2006/0219732 A1 Oct. 5, 2006

(51) Int. Cl.
*B65H 3/00* (2006.01)

(52) U.S. Cl. ..... 221/195; 221/193; 221/150 R; 221/312 R

(58) Field of Classification Search ..... 221/312 R, 221/150 R, 123, 193, 131, 194, 195
See application file for complete search history.

(56) References Cited

U.S. PATENT DOCUMENTS 2,525,261 A * 10/1950 Henderson ..... 221/150 R
2,577,344 A * 12/1951 Masure ..... 221/2
2,799,430 A * 7/1957 Kintzel ..... 221/151
3,287,073 A * 11/1966 Holtkamp ..... 312/36
3,610,466 A 10/1971 Raybois
4,066,186 A 1/1978 Agey
4,150,766 A 4/1979 Westendorf et al.
4,611,727 A 9/1986 Graff
4,782,980 A 11/1988 Heimlich et al.
4,802,609 A 2/1989 Morse et al.
4,888,420 A 12/1989 Steiner et al.
4,911,332 A 3/1990 King
5,105,979 A * 4/1992 Bakx et al. ..... 221/150 HC
5,791,515 A 8/1998 Khan et al.
6,193,999 B1 2/2001 Gennadios
6,237,804 B1 * 5/2001 Peery et al. ..... 221/7
6,755,010 B2 6/2004 Draisey

* cited by examiner

*Primary Examiner*—Gene O Crawford
*Assistant Examiner*—Timothy Waggoner
(74) *Attorney, Agent, or Firm*—Dale J. Ream

(57) ABSTRACT

A capsule dispensing apparatus includes an elongate tube for containing a plurality of capsules and a housing remote from the elongate tube. The elongate tube may be releasably coupled to the housing, and a dispensing arm connected to the housing may control the release of the capsules from the elongate tube. The dispensing arm is preferably a solenoid plunger having an end encircled by a solenoid coil, and the solenoid coil is electrically connected to a power supply and a button for moving the solenoid plunger from an extended configuration to a seated configuration, whereby dispensing a capsule. A refrigeration unit has a cooling coil mounted in an interior space defined by the housing and a heat dissipation coil mounted outside the housing interior space for cooling the capsules, and a counter/alarm system provide notice that a certain number of capsules have been dispensed.

18 Claims, 6 Drawing Sheets

156
138
110
125a
125b
130
150

122a
110
120
2
164
120a
123
162
122b

CAPSULE DISPENSING APPARATUS WITH REFRIGERATION

BACKGROUND AND SUMMARY OF THE INVENTION

This invention relates generally to a capsule dispensing apparatus. In particular, the present invention relates to a gel-cap dispensing apparatus with refrigeration for cooling the gel-caps.

Gel-caps have become increasingly popular in today's marketplace, and especially in the pharmaceutical and nutritional supplement industries. Nevertheless, the potential of gel-caps has not been fully recognized because a convenient way to store and dispense refrigerated gel-caps has been absent. A refrigerated gel-cap dispenser that is convenient to use would open the door for gel-caps to be used for coffee cream and numerous other applications.

Various proposals for pill and capsule dispensers are found in the art, such as in U.S. Pat. Nos. 3,610,466; 4,150,766; 4,611,727; 4,782,980; and 5,791,515. While assumably effective for their intended purposes, the existing devices do not provide a user-friendly gel-cap dispenser with refrigeration. For the reasons discussed above, refrigeration would be advantageous. Therefore, it would be desirable to have a user-friendly gel-cap dispensing apparatus with refrigeration.

A capsule dispensing apparatus according to the present invention includes an elongate tube for containing a plurality of capsules and a housing remote from the elongate tube. The elongate tube may be coupled to the housing, and a dispensing arm connected to the housing may control the release of the capsules from the elongate tube. The dispensing arm is preferably a solenoid plunger having an end encircled by a solenoid coil, and the solenoid coil is electrically connected to a power supply and a button for moving the solenoid plunger from an extended (first) configuration to a seated (second) configuration. The movement of the solenoid plunger to the seated configuration allows a capsule to fall, and thus be dispensed. A refrigeration unit has a cooling coil mounted in an interior space defined by the housing and a heat dissipation coil mounted outside the housing interior space for cooperatively maintaining the capsules at a consistent chosen temperature, and a counter/alarm system provide notice that a certain number of capsules have been dispensed.

Therefore, a general object of this invention is to provide a capsule dispensing apparatus that is refrigerated.

Another object of this invention is to provide a capsule dispensing apparatus, as aforesaid, that may be used in a variety of settings, including restaurants.

Still another object of this invention is to provide a capsule dispensing apparatus, as aforesaid, that may be easily and quickly refilled.

Yet another object of this invention is to provide a capsule dispensing apparatus, as aforesaid, that conveniently dispenses capsules.

A further object of this invention is to provide a capsule dispensing apparatus, as aforesaid, that is sanitary.

A still further object of this invention is to provide a capsule dispensing apparatus, as aforesaid, that is not unduly complex.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figures 1A, 1B:
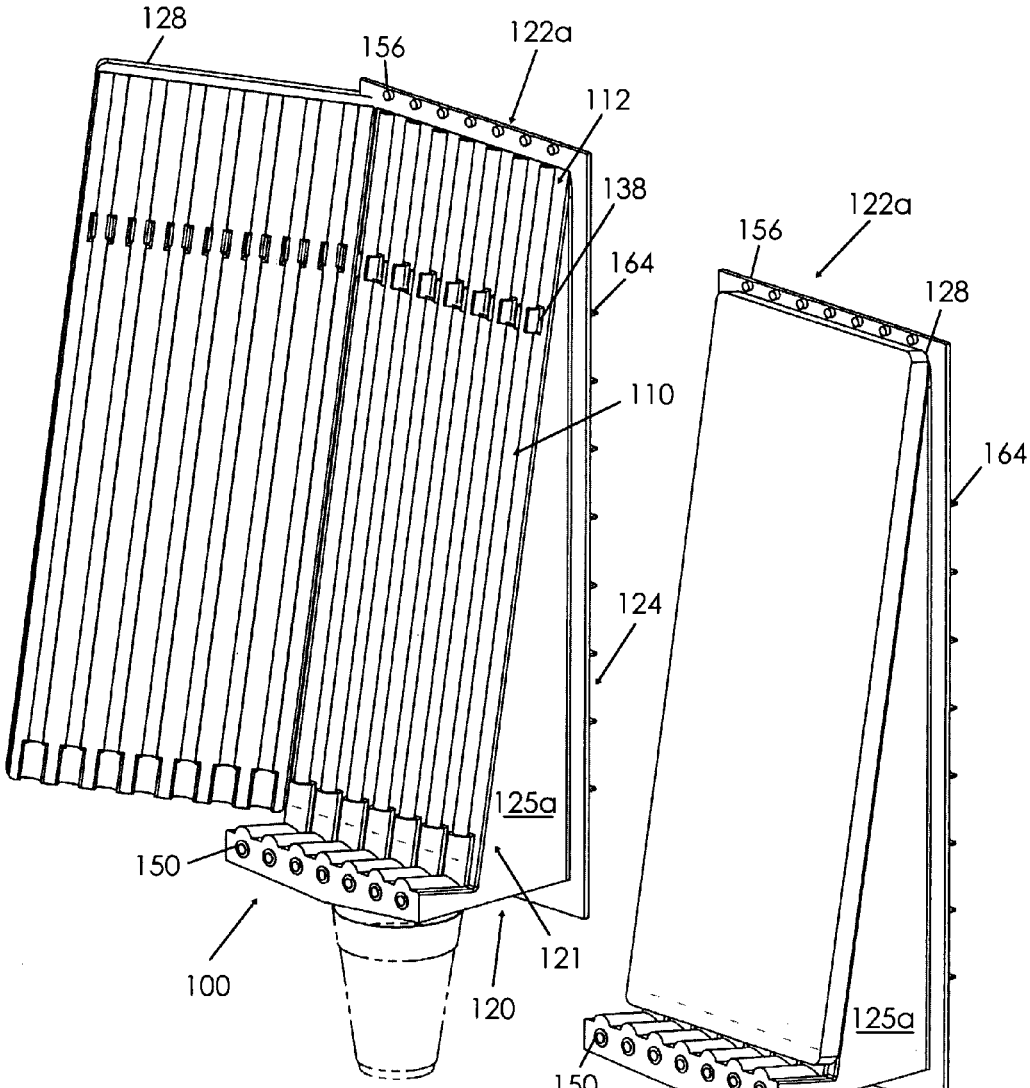
FIG. 1*a* is a perspective view of an apparatus for holding and dispensing a plurality of capsules according to the present invention, shown with the door open and depicting a cup in phantom lines.
FIG. 1*b* is a perspective view of the apparatus as in FIG. 1*a*, shown with the door shut and depicting a cup in phantom lines.
Figure 2:
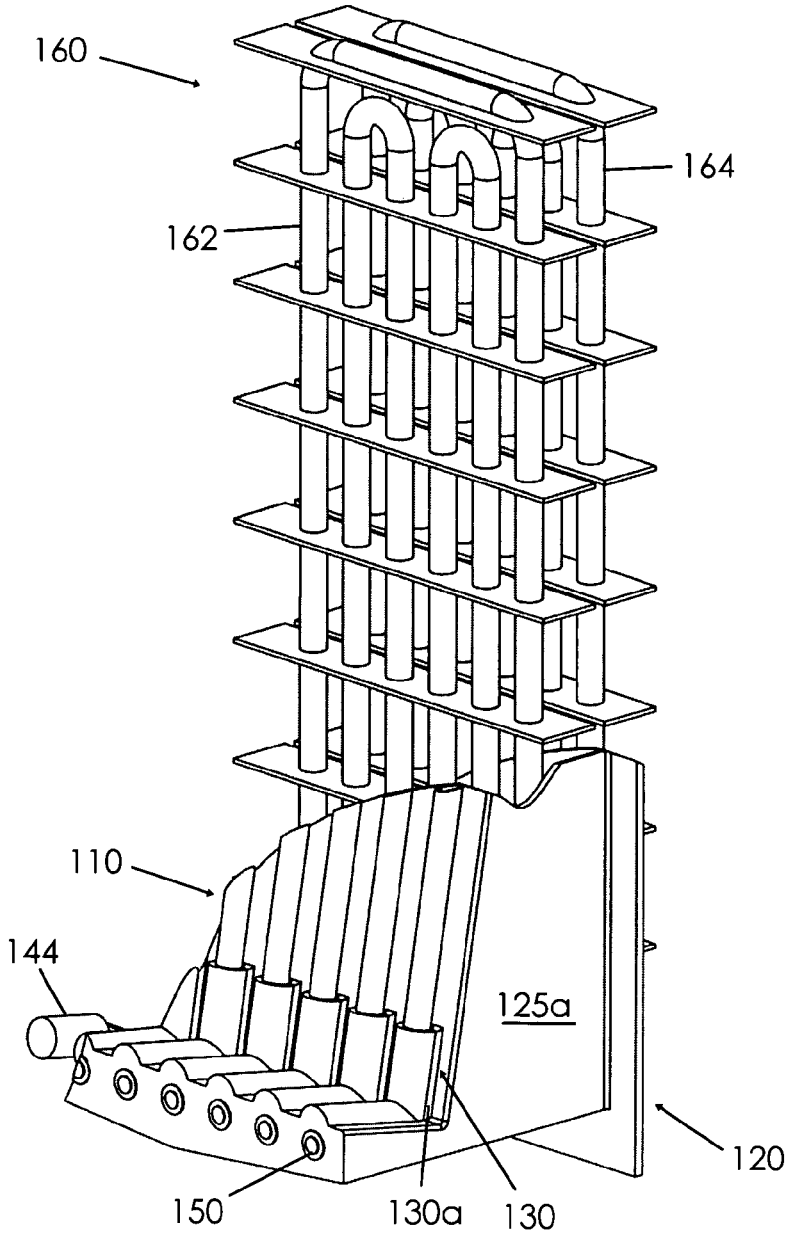
FIG. 2 is a fragmentary perspective view of the apparatus as in FIG. 1*a;*

An apparatus for holding and dispensing a plurality of capsules according to the present invention will now be described in detail with reference to FIGS. 1*a* through 6 of the accompanying drawings. More particularly, an apparatus 100 for holding and dispensing a plurality of capsules 2 includes an elongate tube 110 for containing the plurality of capsules 2 and a housing 120 remote from the elongate tube 110. The capsules 2 are preferably gel-caps.

Figure 5:
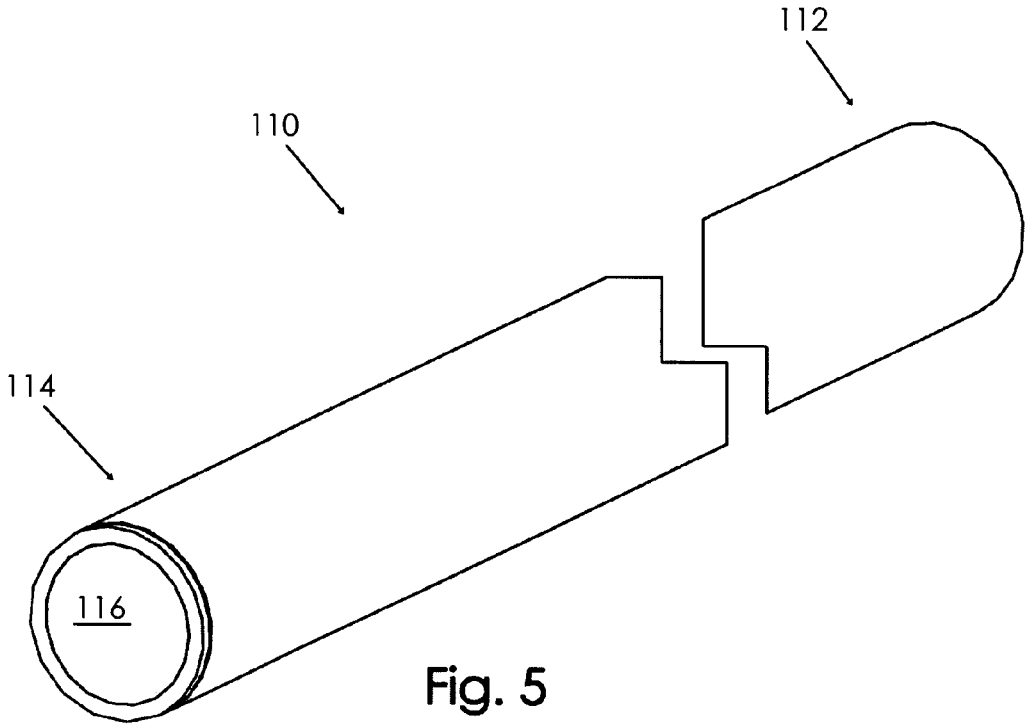
FIG. 5 is an abbreviated perspective view of an elongate tube according to the present invention.

The elongate tube 110 has an upper end 112 and a dispensing end 114 that preferably includes a pierceable region 116 (FIG. 5). The pierceable region 116 may be constructed of foil, a plastic film, or another pierceable material.

Figures 3A, 3B, 4A:
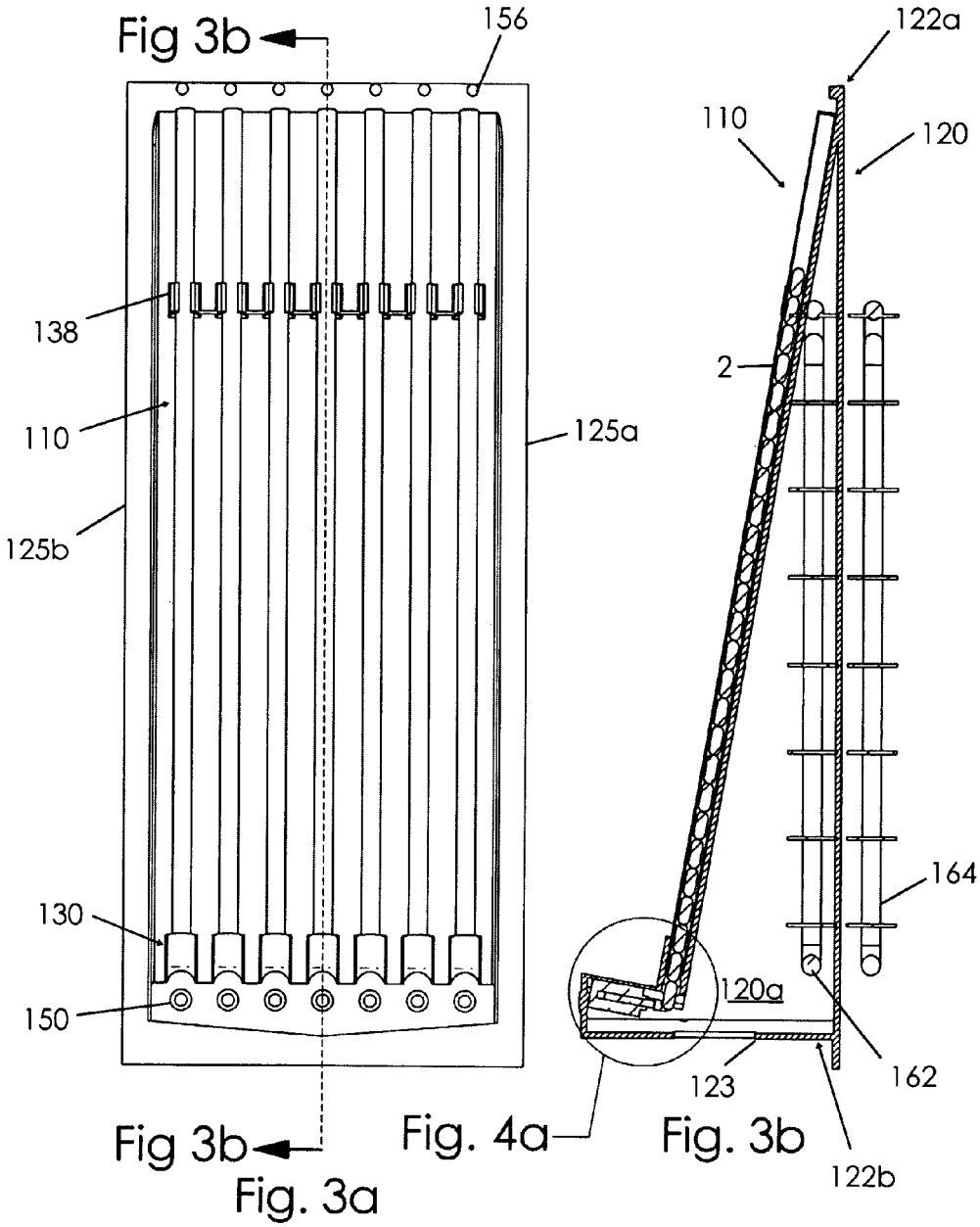
FIG. 3*a* is a front view of the apparatus as in FIG. 1*a;*
FIG. 3*b* is a sectional view taken along line 3*b*-3*b* of FIG. 3*a*.
FIG. 4*a* is a sectional view on an enlarged scale taken from FIG. 3*b*.
Figure 4A:
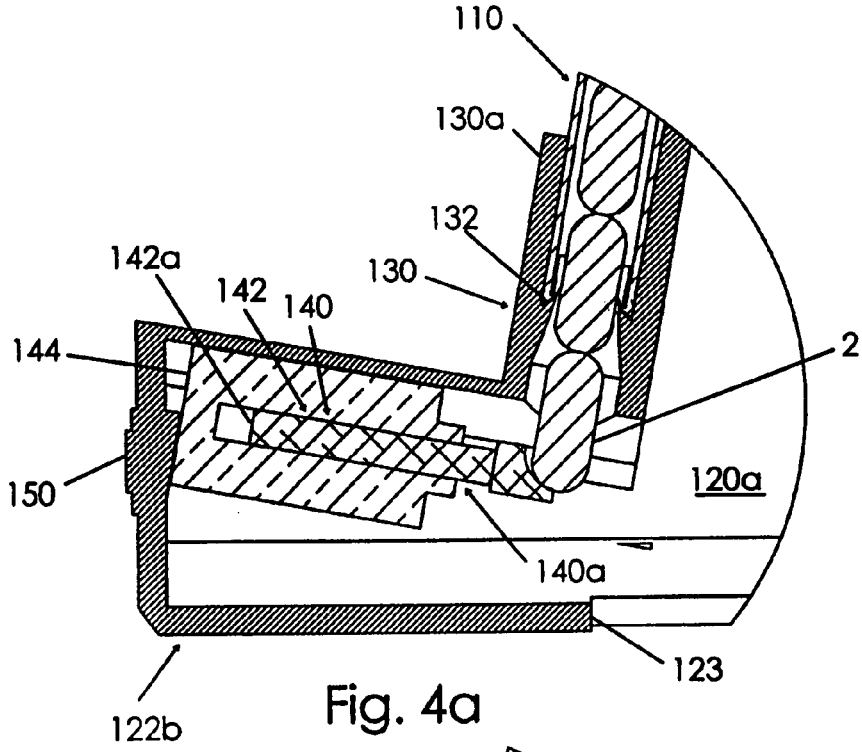
Figure 4B:
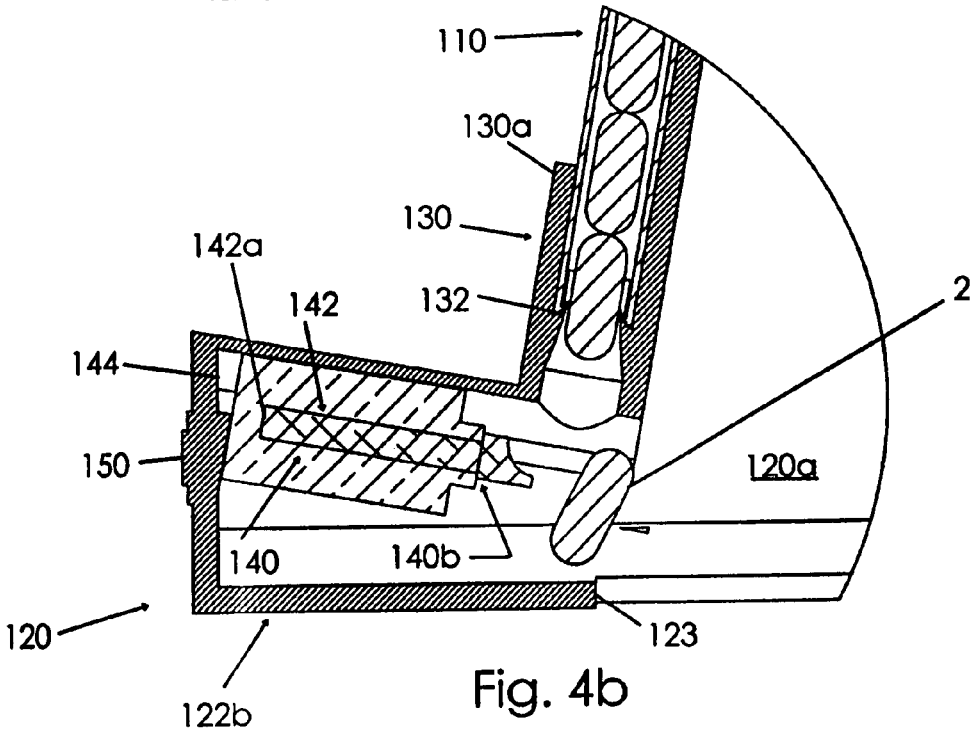
FIG. 4*b* is a sectional view as in FIG. 4*a*, shown with the dispensing arm in a second configuration and a capsule being dispensed.

The housing 120 preferably defines an interior space 120*a* and has first and second sides 121, 124, opposed lateral sides 125*a*, 125*b*, an upper end 122*a*, and a lower end 122*b* defining a dispensing opening 123 (FIGS. 3*a* and 3*b*). A lower fastener 130 is attached to the housing first side 121 adjacent the housing lower end 122*b* for releasably coupling the elongate tube dispensing end 114 to the housing 120 upwardly adjacent the dispensing opening 123 (FIGS. 1*a*, 4*a*, and 4*b*). The lower fastener 130 preferably includes an annular collar 130*a* having a configuration complementary to a configuration of said elongate tube dispensing end 114 to easily and stably couple the elongate tube dispensing end 114 to the housing 120. A cutter 132 is preferably included in the lower fastener 130 for piercing the pierceable region 116 of the elongate tube 110 when the dispensing end 114 of the elongate tube 110 is coupled to the housing 120 (FIGS. 4*a* and 4*b*). An upper fastener 138 is attached to the housing first side 121 adjacent the housing upper end 122*a* for releasably coupling the elongate tube upper end 112 to the housing 120 (FIGS. 1*a* and 3*a*). The upper and lower fasteners 138, 130 may be one continuous fastener (not shown).

A dispensing arm 140 is operatively connected to the housing 120 upwardly adjacent the dispensing opening 123 for movement between a first configuration 140*a* in which a respective capsule 2 from the elongate tube 110 is restrained on the dispensing arm 140 (FIG. 4*a*) and a second configuration 140*b* in which the respective capsule 2 is dispensed (FIG. 4*b*). A button 150 is in communication with the dispensing arm 140 for moving the dispensing arm 140 from the first configuration 140*a* (FIG. 4*a*) to the second configuration 140*b* (FIG. 4*b*) when the button 150 is activated. The dispensing arm 140 is preferably a solenoid plunger 142, though the dispensing arm 140 could be a mechanical arm. A solenoid coil 144 encircles an end 142*a* of the solenoid plunger 142 and is electrically connected to a power supply 152 and the button 150 (FIG. 6) for moving the solenoid plunger 142 from the first configuration 140*a* (FIG. 4*a*) to the second configuration 140*b* (FIG. 4*b*). The first configuration 140*a* is preferably an extended configuration, and the second configuration 140*b* is preferably a seated configuration.

A refrigeration unit 160 (FIGS. 2 and 3*b*) has a cooling coil 162 mounted in the housing interior space 120*a* and a heat dissipation coil 164 mounted outside the housing interior space 120*a* for cooling the plurality of capsules 2. The refrigeration unit 160 may be attached to a power supply to function, such as a building's electrical system, and cools in a manner well known in the art.

A door 128 is attached to the housing 120 for selectively covering the housing first side 121 and the elongate tube 110 (FIGS. 1*a* and 1*b*). While the door 128 is preferably pivotally attached to the housing 120 to allow easy access to the elongate tube 110, other methods of attachment are of course possible. The door 128, the housing second side 124, the housing upper and lower ends 122*a*, 122*b*, and the housing lateral sides 125*a*, 125*b*, are preferably insulated to maintain the plurality of capsules 2 at a consistent temperature provided by the cooling coil 162.

Figure 6:
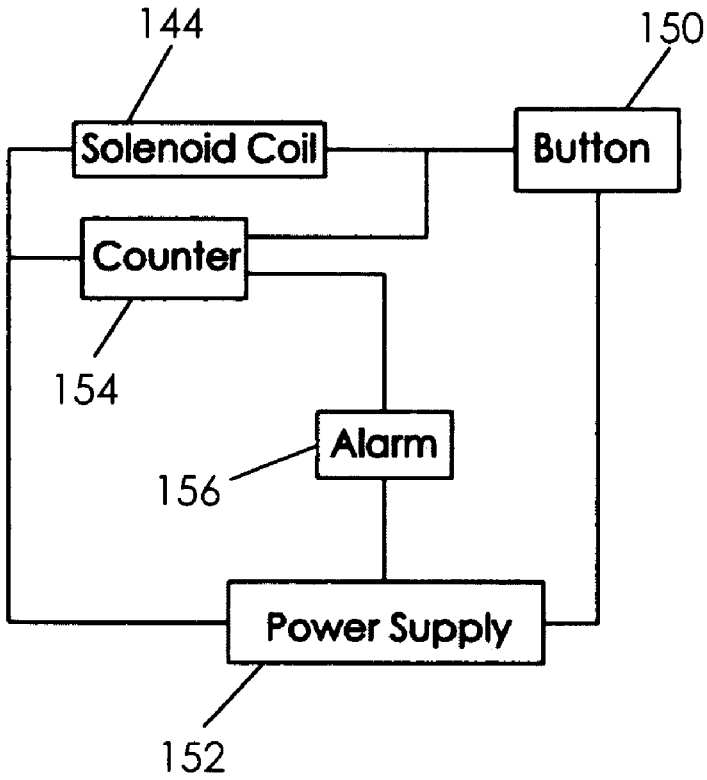
FIG. 6 is a block diagram of electrical components of the apparatus as in FIG. 1*a*.

A counter 154 is connected to the button 150 for tracking the number of times the button 150 is activated, and an alarm 156 is connected to the housing 120 and the counter 154 for signaling that the counter 154 has reached a predetermined number (FIG. 6). The alarm 156 is preferably a light (FIGS. 1*a* and 1*b*), though other visual and audible alarming devices may be used.

In use, the elongate tube dispensing end 114 is coupled to the lower fastener 130 and the elongate tube upper end 112 is coupled to the upper fastener 138. The complementary configurations of the elongate tube dispensing end 114 and the lower fastener annular collar 130*a* allow the elongate tube dispensing end 114 and the lower fastener 130 to be easily and stably coupled together. The cutter 132 pierces the pierceable region 116 of the elongate tube 110 when the elongate tube dispensing end 114 is coupled to the lower fastener 130. The piercing of the elongate tube dispensing end 114 allows a respective capsule 2 contained in the elongate tube 110 to fall from the elongate tube 110 and reach the dispensing arm 140 (FIG. 4*a*).

Once the elongate tube 110 is coupled to the housing 120, the door 128 may be shut (FIG. 1*b*), covering the elongate tube 110 and the housing first side 121. The cooling coil 162 and the heat dissipation coil 164 may cooperatively maintain the plurality of capsules 2 at a consistent chosen temperature.

To dispense a capsule 2 from the apparatus 100, a user may activate the button 150. Activating the button 150 causes the solenoid coil 144 to temporarily energize using the power supply 152, which in turn moves the solenoid plunger 142 from the extended configuration 140*a* (FIG. 4*a*) to the seated configuration 140*b* (FIG. 4*b*). When the solenoid plunger 142 moves from the extended configuration 140*a*, the respective capsule 2 that was resting on the solenoid plunger 142 is no longer held in place, and is thus dispensed through the dispensing opening 123. When the solenoid plunger 142 moves to the seated configuration 140*b*, the solenoid coil 144 is no longer energized and the solenoid plunger 142 returns to the extended configuration 140*a*. The next capsule 2 in the elongate tube 110 then falls from the elongate tube 110 and reaches the dispensing arm 140, where the capsule 2 rests until the button 150 is activated.

When the button 150 was activated, the counter 154 connected to the button 150 increased to track the number of times that the button 150 has been activated. When the counter 154 reaches a predetermined number, the alarm 156 connected to the counter 154 signals that the counter 154 has reached the predetermined number. This is useful in indicating when the elongate tube 110 no longer contains any capsules 2 or when the elongate tube 110 contains only a few capsules 2. The counter 154 may be reset when a new elongate tube 110 is coupled to the housing 120.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An apparatus for holding and dispensing a plurality of gel-caps, comprising:

an elongate tube for containing the plurality of gel-caps, said elongate tube having a dispensing end;

a housing remote from said elongate tube and having a first side, an upper end, and a lower end defining a dispensing opening;

a lower fastener attached to said housing first side adjacent said housing lower end for coupling said dispensing end of said elongate tube to said housing upwardly adjacent said dispensing opening;

a dispensing arm operatively connected to said housing upwardly adjacent said dispensing opening, said dispensing arm being movable between a first configuration in which a respective gel-cap from said elongate tube is restrained on said dispensing arm and a second configuration in which the respective gel-cap is dispensed;

a button in communication with said dispensing arm for moving said dispensing arm from said first configuration to said second configuration when said button is activated; and wherein:

said dispensing end of said elongate tube includes a pierceable region; and said lower fastener includes a cutter for piercing said pierceable region of said elongate tube when said dispensing end of said elongate tube is coupled to said housing, whereby allowing a respective gel-cap contained in said elongate tube to reach said dispensing arm.

2. The apparatus as in claim 1, further comprising an upper fastener attached to said housing first side adjacent said housing upper end for coupling an upper end of said elongate tube to said housing.

3. The apparatus as in claim 1, wherein said housing defines an interior space, said apparatus further comprising a refrigeration unit having a cooling coil mounted in said housing interior space and a heat dissipation coil mounted outside said housing interior space for cooling the plurality of gel-caps.

4. The apparatus as in claim 3, further comprising an insulated door pivotally attached to said housing for selectively covering said housing first side and said elongate tube, whereby to maintain the plurality of gel-caps at a consistent temperature provided by said cooling coil.

5. The apparatus as in claim 1, further comprising a door attached to said housing for selectively covering said housing first side and said elongate tube.

6. The apparatus as in claim 1, wherein said dispensing arm is a solenoid plunger, said apparatus further comprising:

a solenoid coil encircling an end of said solenoid plunger and electrically connected to a power supply and said button for selectively moving said solenoid plunger from said first configuration to said second configuration;

wherein said first configuration is an extended configuration; and wherein said second configuration is a seated configuration.

7. The apparatus as in claim 6, further comprising:

a counter connected to said button for tracking the number of times said button is activated; and an alarm connected to said housing and said counter for signaling that said counter has reached a predetermined number.

8. The apparatus as in claim 7, wherein said alarm is a light.

9. The apparatus as in claim 1, further comprising:

a counter attached to said button for tracking the number of times said button is activated; and an alarm attached to said housing and said counter for signaling that said counter has reached a predetermined number.

10. The apparatus as in claim 1, wherein said lower fastener includes an annular collar having a configuration complementary to a configuration of said elongate tube dispensing end.

11. An apparatus for holding and dispensing a plurality of capsules, comprising:

an elongate tube for containing the plurality of capsules, said elongate tube having a dispensing end;

a housing remote from the elongate tube and having a first side, an upper end, and a lower end defining a dispensing opening, said housing defining an interior space;

a lower fastener attached to said housing first side adjacent said housing lower end for releasably coupling said dispensing end of said elongate tube to said housing upwardly adjacent said dispensing opening;

an upper fastener attached to said housing first side adjacent said housing upper end for releasably coupling an upper end of said elongate tube to said housing;

a dispensing arm operatively connected to said housing upwardly adjacent said dispensing opening for movement between a first configuration in which a respective capsule from said elongate tube is restrained on said dispensing arm and a second configuration in which the respective capsule is dispensed;

a button in communication with said dispensing arm for moving said dispensing arm from said first configuration to said second configuration when said button is activated;

a refrigeration unit having a cooling coil mounted in said housing interior space and a heat dissipation coil mounted outside said housing interior space for cooling the plurality of capsules;

wherein:

said dispensing end of said elongate tube includes a pierceable region; and said lower fastener includes a cutter for piercing said pierceable region of said elongate tube when said dispensing end of said elongate tube is coupled to said housing, whereby allowing a respective capsule contained in said elongate tube to reach said dispensing arm.

12. The apparatus as in claim 11, further comprising a door attached to said housing for selectively covering said housing first side and said elongate tube.

13. The apparatus as in claim 11, further comprising an insulated door attached to said housing for selectively covering said housing first side and said elongate tube, whereby to maintain the plurality of capsules at a consistent temperature provided by said cooling coil.

14. The apparatus as in claim 11, wherein said dispensing arm is a solenoid plunger, said apparatus further comprising:

a solenoid coil encircling an end of said solenoid plunger and electrically connected to a power supply and said button for moving said solenoid plunger from said first configuration to said second configuration;

wherein said first configuration is an extended configuration; and wherein said second configuration is a seated configuration.

15. The apparatus as in claim 11, further comprising:

a counter attached to said button for tracking the number of times said button is activated; and an alarm attached to said housing and said counter for signaling that said counter has reached a predetermined number.

16. The apparatus as in claim 15, wherein said alarm is a light.

17. The apparatus as in claim 11, wherein said lower fastener includes an annular collar having a configuration complementary to a configuration of said elongate tube dispensing end.

18. The apparatus as in claim 17, wherein said dispensing arm is a solenoid plunger, said apparatus further comprising:

a solenoid coil encircling an end of said solenoid plunger and electrically connected to a power supply and said button for moving said solenoid plunger from said first configuration to said second configuration;

an insulated door attached to said housing for selectively covering said housing first side and said elongate tube, whereby to maintain the plurality of capsules at a consistent temperature provided by said cooling coil;

a counter attached to said button for tracking the number of times said button is activated;

an alarm attached to said housing and said counter for signaling that said counter has reached a predetermined number;

wherein said dispensing end of said elongate tube includes a pierceable region; and wherein said lower fastener includes a cutter for piercing said pierceable region of said elongate tube when said dispensing end of said elongate tube is coupled to said housing, whereby allowing a respective capsule contained in said elongate tube to reach said dispensing arm.

* * * * *